US006896486B2

(12) United States Patent
Takehana et al.

(10) Patent No.: US 6,896,486 B2
(45) Date of Patent: May 24, 2005

(54) WATER PUMP

(75) Inventors: Norio Takehana, Iwate-ken (JP); Takehiko Naiki, Iwate-ken (JP); Makoto Shichi, Iwate-ken (JP)

(73) Assignee: Mikuni Corporation, Tokyo (JP)

( * ) Notice: Subject to any disclaimer, the term of this patent is extended or adjusted under 35 U.S.C. 154(b) by 0 days.

(21) Appl. No.: 10/658,426

(22) Filed: Sep. 10, 2003

(65) Prior Publication Data

US 2004/0086402 A1 May 6, 2004

(30) Foreign Application Priority Data

Sep. 18, 2002 (JP) ..... 2002-271439

(51) Int. Cl.[7] ..... F04D 29/10
(52) U.S. Cl. ..... 415/231; 415/915
(58) Field of Search ..... 415/171.1, 174.2, 415/174.3, 231, 915; 416/244 R

(56) References Cited

U.S. PATENT DOCUMENTS 2,170,134 A * 8/1939 Flick ..... 384/149
2,842,063 A * 7/1958 Kishline et al. ..... 415/182.1
4,784,088 A * 11/1988 Tamba et al. ..... 123/41.47

FOREIGN PATENT DOCUMENTS

JP 6-31197 8/1994
JP 2000-87744 3/2000

* cited by examiner

*Primary Examiner*—Ninh H. Nguyen
(74) *Attorney, Agent, or Firm*—Wenderoth, Lind & Ponack L.L.P.

(57) ABSTRACT

A water pump includes an engage mechanism 25 which is disposed between a pump body 21 and the end portion of a pump shaft 23 opposite to the side where an impeller 22 is attached, while engaging the pump shaft to the pump body against the urging force of the urging member which urges a mechanical seal 24. The engage mechanism includes an annular member 26 which is rotatably fitted to the pump shaft 23 while contacting the pump body 21, and a cylindrical engage pin 27 which pierces the pump shaft 23 in the diameter direction while sandwiching the annular member 26 with the pump body 21.

14 Claims, 7 Drawing Sheets

WATER PUMP

BACKGROUND OF THE INVENTION

1. Field of the Invention

The present invention relates to a water pump, and particularly relates to a water pump which circulates cooling water of a water-cooled internal combustion engine within the internal combustion engine.

2. Description of the Related Art

Conventionally, with a water-cooled internal combustion engine 1 shown in FIG. 5 for example, a water pump 2 is disposed to perform cooling of the internal combustion engine 1.

The water pump 2 is disposed integrally to a crank case 3 of the internal combustion engine 1, and driven by a crank shaft 4 which is accommodated in the crank case 3. With this structure, cooling water which is cooled by a radiator, not shown in figures, is led to a water jacket 6 in a cylinder block 5 of the internal combustion engine 1 for example, and the cooling is performed.

As shown in FIG. 6, the water pump 2 comprises a pump body 7, a pump shaft 9 which is rotatably supported by the pump body 7 in a piercing state and to which an impeller 8 is attached at one end portion, and a mechanical seal 10 which is elastically disposed between the side of the pump shaft 9 where the impeller 8 is attached and the pump body 7.

The mechanical seal 10 is constructed by a seal member 11 and a spring 12 which elastically urges the seal member 11 towards the impeller 8.

Here, when the mechanical seal 10 is disposed, contact pressure between the mechanical seal 10 and the impeller 8 has to be ensured. Further, the dislodging of the pump shaft 9 from the pump body 7 by the urging force of the mechanical seal 10 has to be prevented. For these purposes, a dislodging prevention pin 13 is disposed to the pump shaft 9 opposite to the side where the impeller 8 is attached, being in contact with the pump body 7, so as to receive force in the thrust direction generated by the mechanical seal 10.

Further, the pump shaft 9 has a two-point mounting structure that a midway portion is rotatably supported by the pump body 7, and an end portion is rotatably supported by the crank case 3 to which the pump body 7 is attached. For example, FIG. 1 of Japanese Utility-model Kokoku H6-31197 discloses this structure.

Furthermore, FIG. 7 shows another structure example of the water pump 2 of the related art. With this water pump 2, a flange 14 is integrally formed at the midway portion of the pump shaft 9 so as to receive the force in the thrust direction generated by the mechanical seal 10 and prevent dislodging of the pump shaft 9. For example, FIG. 1 of Japanese Patent Laid-open 2000-87744 discloses this structure.

Here, since the pump shaft 9 of the abovementioned former water pump 2 is supported by two points which are apart from each other, it has following problems to be solved.

Specifically, because one of the supporting points of the pump shaft 9 is disposed at the pump body 7, and the other supporting point is disposed at the crank case 3 to which the pump body 7 is attached, the axes of the two supporting points have to be aligned accurately. As a result, there arises a problem that high accuracy machining is required and the manufacturing cost is increased.

Further, in addition to the abovementioned machining accuracy of the supporting points, since the assembling accuracy of the pump body 7 with the crank case 3 affects the abovementioned alignment accuracy, there arises a problem that the assembling process becomes complicated.

Next, with the abovementioned latter water pump 2, because the pump shaft 9 is supported at one point, the problems of the former water pump 2 are solved. However, since the flange 14 to prevent dislodging has to be formed integrally with the pump shaft 9, following problems have to be solved.

Specifically, because the flange 14 is formed integrally with the pump shaft 9, a simple machining method, such as centerless grinding, cannot be adopted when grinding the outer face of the pump shaft 9. As a result, there arises a problem that the manufacturing cost is increased.

Further, as mentioned above, because the flange 14 is formed integrally with the pump shaft 9, at the time of assembling, the impeller 8 has to be attached to the pump shaft 9 after the pump shaft 9 is inserted to the pump body 7. Therefore, the impeller 8 cannot be assembled with the pump shaft 9 in advance.

As a result, the assembling process is restricted.

The present invention was devised in the light of the abovementioned problems. The object is to provide a water pump which machining accuracy and assembling accuracy can be easily improved.

SUMMARY OF THE INVENTION

To achieve the abovementioned object, the water pump of the present invention comprises, a pump body, a pump shaft which is rotatably supported by the pump body in a piercing state and to which an impeller is attached at one end portion, a mechanical seal which is disposed elastically via urging means between the pump body and the end portion of the pump shaft where the impeller is attached, and an engage mechanism which is disposed between the pump body and the end portion of the pump shaft opposite to the side where the impeller is attached, while engaging the pump shaft to the pump body against the urging force of the urging means. The engage mechanism comprises an annular member which is rotatably fitted to the pump shaft while contacting the pump body, and a cylindrical engage pin which pierces the pump shaft in the diameter direction while sandwiching the annular member with the pump body.

With the water pump of the present invention, the annular member may be formed so that the cross section in the diameter direction is roughly circular.

With the water pump of the present invention, the annular member may be formed so that the cross section in the diameter direction is plate-shaped, and an annular flange is formed at the circumference portion so as to face the end face of the engage pin.

With the water pump of the present invention, the urging means may be formed so that the possible expansion-and-contraction stroke is at least equal to the height of the flange.

With the water pump of the present invention, the impeller may be attached integrally to the pump shaft.

With the water pump of claim 6 of the present invention, the impeller may be integrated with the pump shaft by insert molding.

With the water pump of the present invention, the pump shaft is supported at one point so that the alignment to the pump body can be easily performed.

Further, since the part projecting outside in the diameter direction is eliminated from the face of the pump shaft, the grinding of the outer face can be easily performed and the accurate machining can be obtained. As a result, smooth rotation of the pump shaft can be ensured. Further, a simple machining method, such as centerless grinding, can be adopted. This method, as well as the abovementioned easiness of the alignment, enables the reduction of the machining cost.

BRIEF DESCRIPTION OF THE DRAWINGS

FIGS. 2(*a*) is a longitudinal sectional view, and (*b*) is a front view.

FIG. 4(*a*) is a longitudinal sectional view, and (*b*) is a front view.

DESCRIPTION OF THE PREFFERED EMBODIMENT

An embodiment of the present invention is explained in the following with reference to FIG. 1 through 3.

Here, in the following explanation, the same numerical numbers are given to the same structure of the related art to simplify the explanation.

Figure 1:
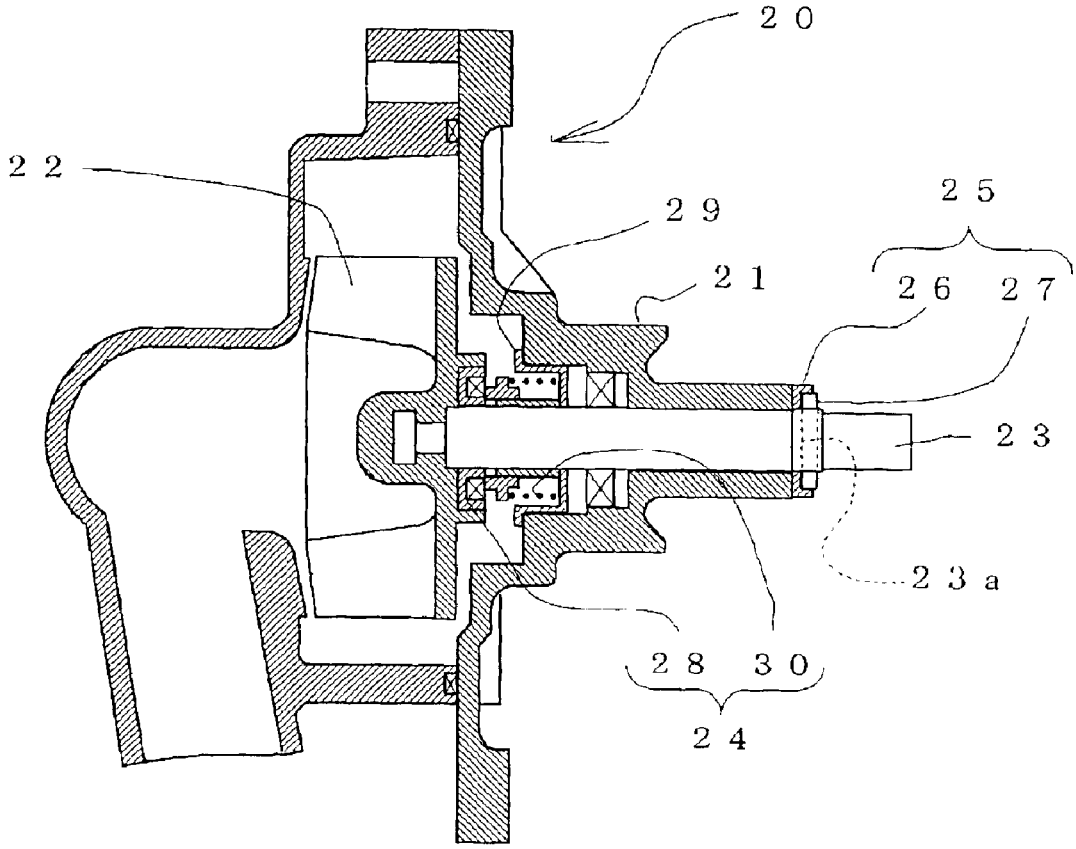
FIG. 1 is a longitudinal sectional view showing an embodiment of the present invention.

The water pump shown by numeral 20 in FIG. 1 basically comprises a pump body 21 which is attached to the crank case 3, a pump shaft 23 which is rotatably supported by the pump body 21 in a piercing state and to which an impeller 22 is attached at one end portion, and a mechanical seal 24 which is disposed elastically via urging means between the pump body 21 and the end portion of the pump shaft 23 where the impeller 22 is attached. An engage mechanism 25 which is disposed between the pump body 21 and the end portion of the pump shaft 23 opposite to the side where the impeller 22 is attached, and engages the pump shaft 23 to the pump body 21 against the urging force of the urging means The engage mechanism 25 comprises an annular member 26 rotatably fitted to the pump shaft 23 while contacting the pump body 21, and a cylindrical engage pin 27 which pierces the pump shaft 23 in the diameter direction while sandwiching the annular member 26 with the pump body 21.

Following is more precise explanation. The mechanical seal 24 is constructed of a seal member 28 which is pressed to contact the side face of a rotating center portion of the impeller 22, and an urging member 30 having a spring etc. which is disposed between the seal member 28 and a spring seat 29 engaged in the pump body 21 so that the seal member 28 is pressed to contact the impeller 22 elastically.

Figure 2:
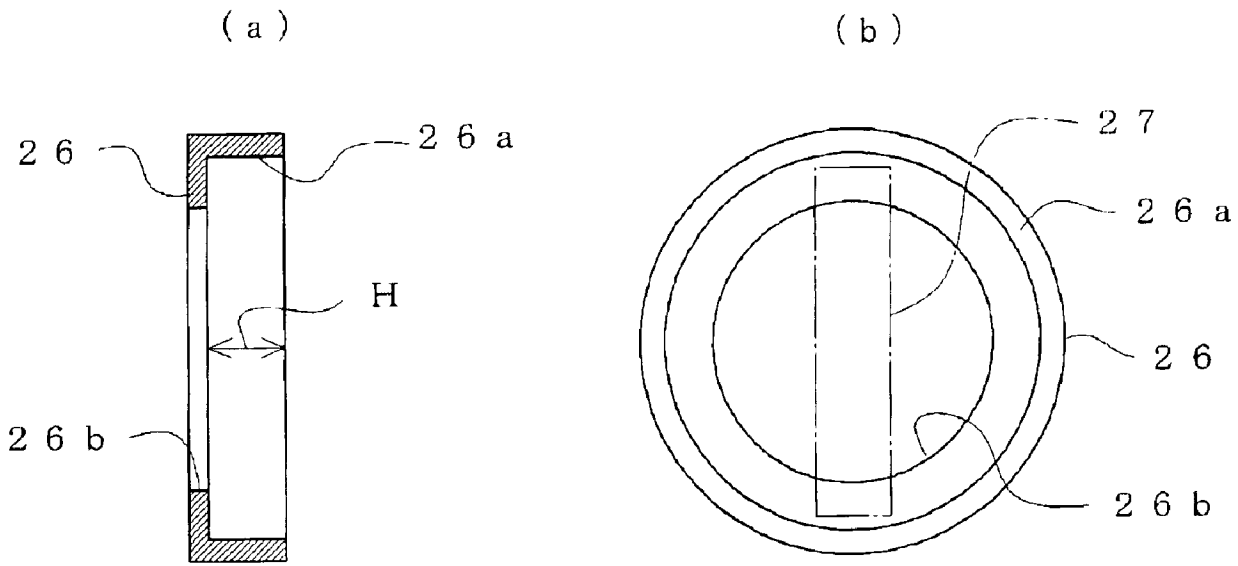
FIG. 2 shows an annular member for an embodiment of the present invention.

As precisely shown in FIG. 2, with this embodiment, the annular member 26 is formed so that the cross section in the diameter direction is plate-shaped, and annular flange 26*a* is formed at its circumference portion (i.e., along a circumference of a plate-shaped base portion, as illustrated in FIG. 2*a*) so as to face the end face of the engage pin 27. As a whole, the annular member 26 has a bowl-shape, and a penetrating hole 26*b* to which the pump shaft 23 is inserted is formed around its center.

Here, the inner diameter of the flange 26*a* is larger than the length of the engage pin 27, so that the engage pin 27 can be housed in the flange 26*a*. With this structure, when the engage pin 27 rotates with the pump shaft 23, the flange 26*a* prevents oil which is stuck to the engage pin 27 from splashing. Therefore, the splashing of the oil to lubricate the engage pin 27 and the annular member 26 can be prevented.

As shown in FIG. 1, a piercing hole 23*a* is formed in the pump shaft 23 in the diameter direction to which the engage pin 27 is fitted.

Further, the urging member 30 is constructed so that the amount of the expansion-and-contraction stroke is equal to or larger than the height H of the flange 26*a*. When the urging member 30 is contracted, the piercing hole 23*a* which is formed at the pump shaft 23 is positioned outside the flange 26*a* of the annular member 26 which contacts the pump body 21.

Meanwhile, in this embodiment, the impeller 22 is formed of synthetic resin, and is attached integrally to a first end portion of the pump shaft 23 by insert molding, as shown in FIG. 1.

Following is the explanation of the assembling process of the water pump 20 of this embodiment, which is constructed as mentioned above.

First, the seal member 28 of the mechanical seal 24 is attached to the impeller 22. Then, the urging member 30 of the mechanical seal 24 is attached to one end portion of the inserted part of the pump body 21 into which the pump shaft 23 is inserted. Then, the pump shaft 23 with the impeller 22 and the seal member 28 attached is inserted through the urging member 30 of the mechanical seal 24, from the second end portion where the impeller 22 is not attached. Then, the second end portion of pump shaft 23 protrudes from the opposite side of the pump body 21, and the annular member 26 is fitted to the second end portion, as shown by the arrow X in FIG. 3.

Next, the pump shaft 23 is further pressed into the pump body 21, so that the urging member 30 constructing the mechanical seal 24 is fully contracted, while the annular member 26 is contacted to the pump body 21.

In this state, the piercing hole 23*a* formed at the pump shaft 23 is positioned at the outer side of the flange 26*a* of the annular member 26.

Figure 3:
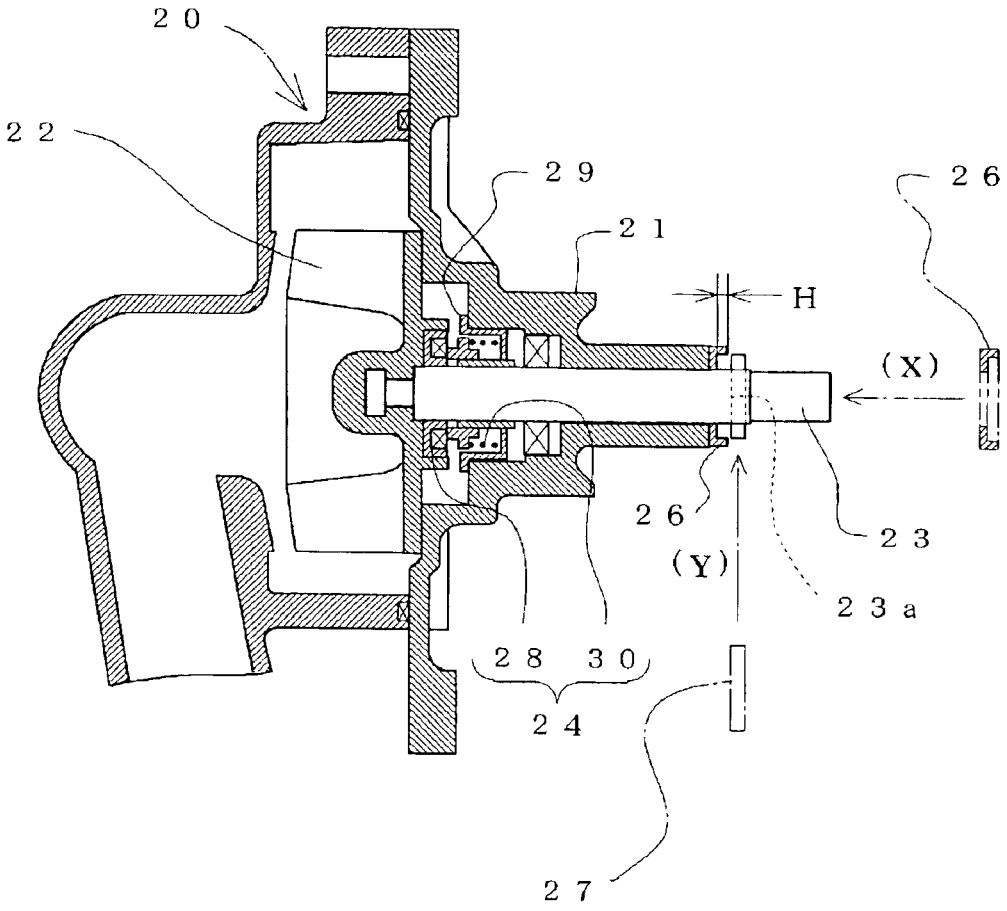
FIG. 3 is a longitudinal sectional view showing an assembling process of an embodiment of the present invention.

Then, as shown by the arrow Y in FIG. 3, the engage pin 27 is fitted in the piercing hole 23*a* of the pump shaft 23. After adjusting the engage pin 27 to position inside the flange 26*a* of the annular member 26, the pressing force to the pump shaft 23 is released.

With the abovementioned process, the pump shaft 23 and the impeller 22 are moved by the urging member 30 constructing mechanical seal 24, in the direction where the impeller 22 is apart from the pump body 21. Then, the engage pin 27 contacts the annular member 26 while being housed in the flange 26*a* of the annular member 26. In this manner, the pump shaft 23 and impeller 22 are attached to the pump body 21, as shown in FIG. 1.

With the water pump 20 of this embodiment assembled as mentioned above, the pump shaft 23 is supported at one point. Therefore, the alignment is easily performed.

Further, the pump shaft 23 has no part projecting outside in the whole range in the diameter direction. Therefore, the grinding of the outer face is easily performed, and accurate machining can be obtained. As a result, smooth rotation of the pump shaft 23 can be ensured. Further, since the pump shaft 23 has no part projecting outside in the diameter direction, a simple machining method, such as centerless grinding, can be adopted to reduce the manufacturing cost.

Further, since the pump shaft 23 has no part projecting outside in the diameter direction, a simple machining method, such as centerless grinding, can be adopted to reduce the manufacturing cost.

Furthermore, since the pump shaft 23 can be attached to the pump body 21 only by being inserted from one direction in the axis direction, it is possible to be assembled in the state that the impeller 22 is attached to the pump shaft 23 at the opposite side of the end portion which is inserted to the pump body 21. Therefore, the impeller 22 can be assembled with the pump shaft 23 in advance, and the assembling performance of the water pump 20 is improved as a whole.

Furthermore, with this embodiment, since the flange 26*a* formed at the annular member 26 covers the end portion of the engage pin 27 which contacts the annular member 26, it is possible to prevent the splashing of the oil sticking at the contacting section of the engage pin 27 and the annular member 26. Therefore, smooth sliding between the engage pin 27 and the annular member 26 can be ensured.

The shapes and dimensions etc. of each constructing member of the abovementioned embodiment are just examples, and can be modified variously in accordance with design requirement etc.

For example, the annular member 26 is not limited to an integrally formed bowl-shaped washer. The same effects can be obtained even when the plate portion which contacts the engage pin 27 and the flange 26*a* which covers the end portion of the engage pin 27 are formed separately.

Figure 4:
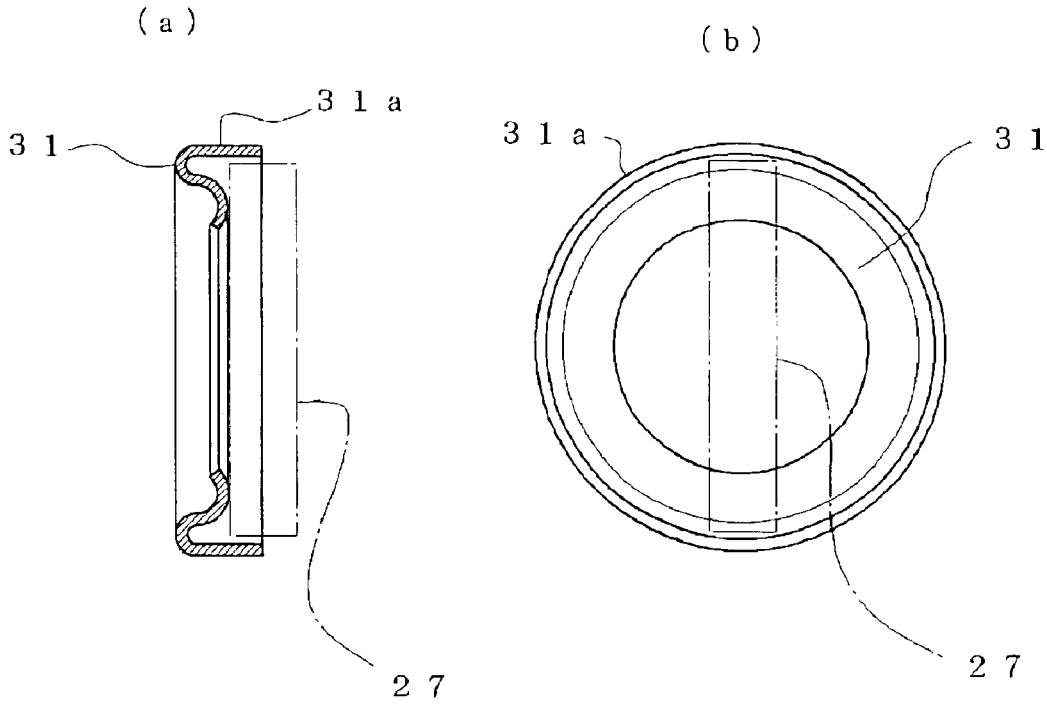
FIG. 4 shows another embodiment of the present invention.
Figure 5:
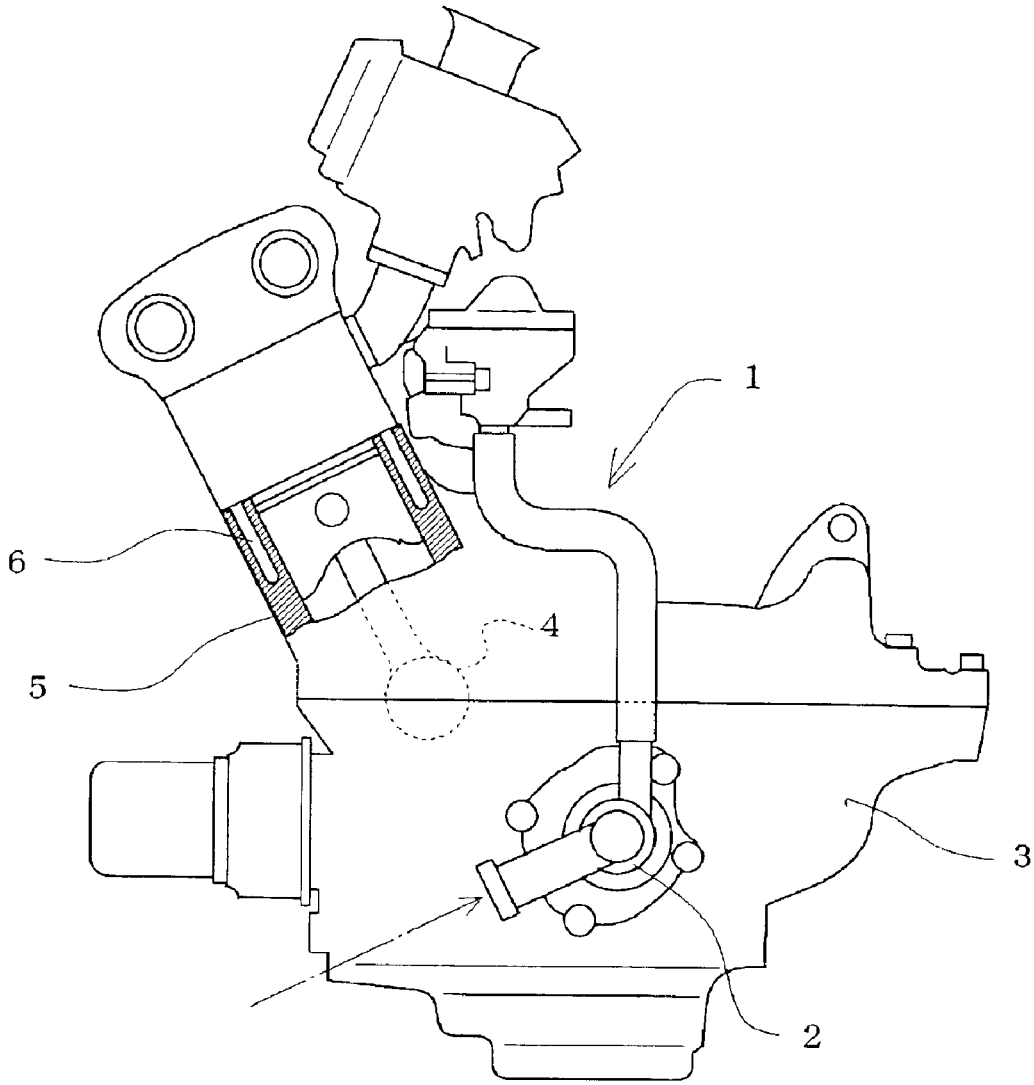
FIG. 5 is a schematic side view of an internal combustion engine to which a water pump is adopted.
Figure 6:
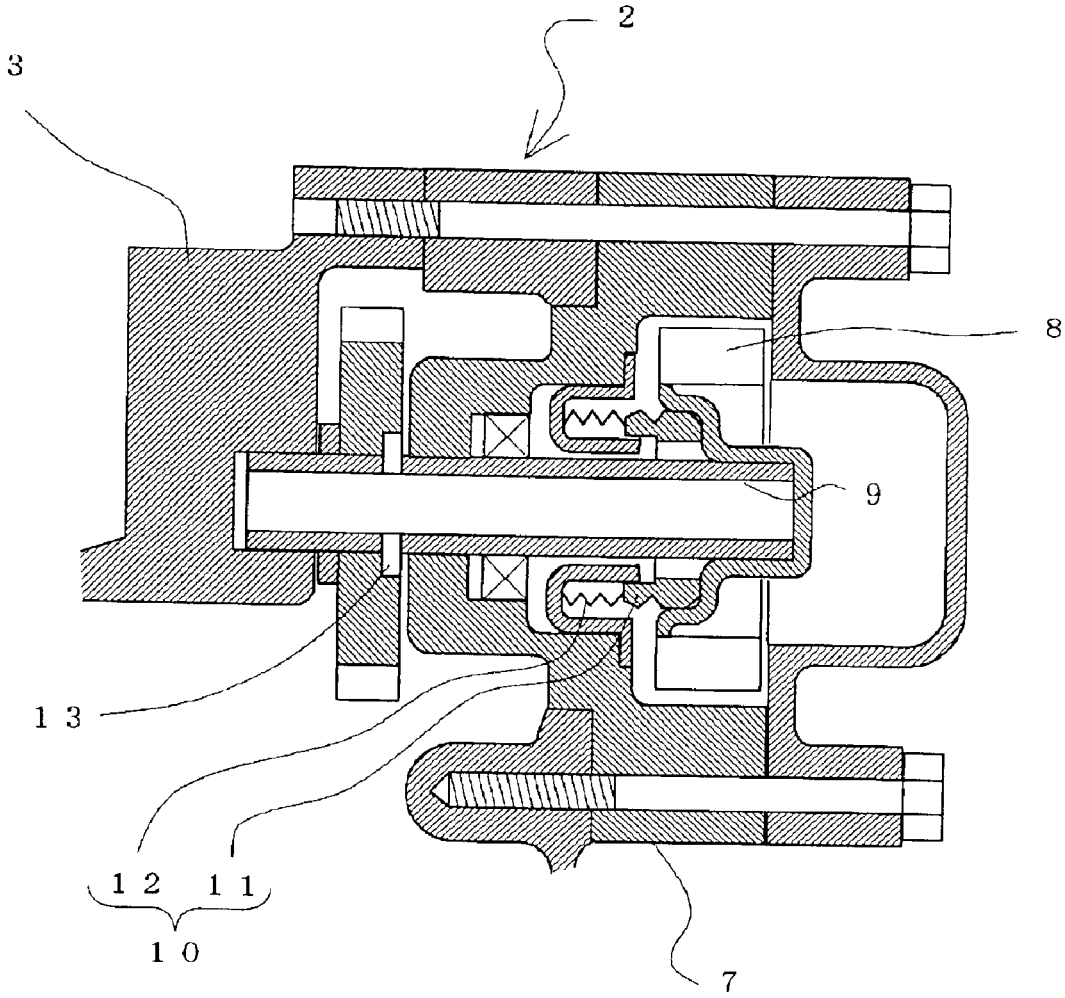
FIG. 6 is a longitudinal sectional view showing an example of the related art.
Figure 7:
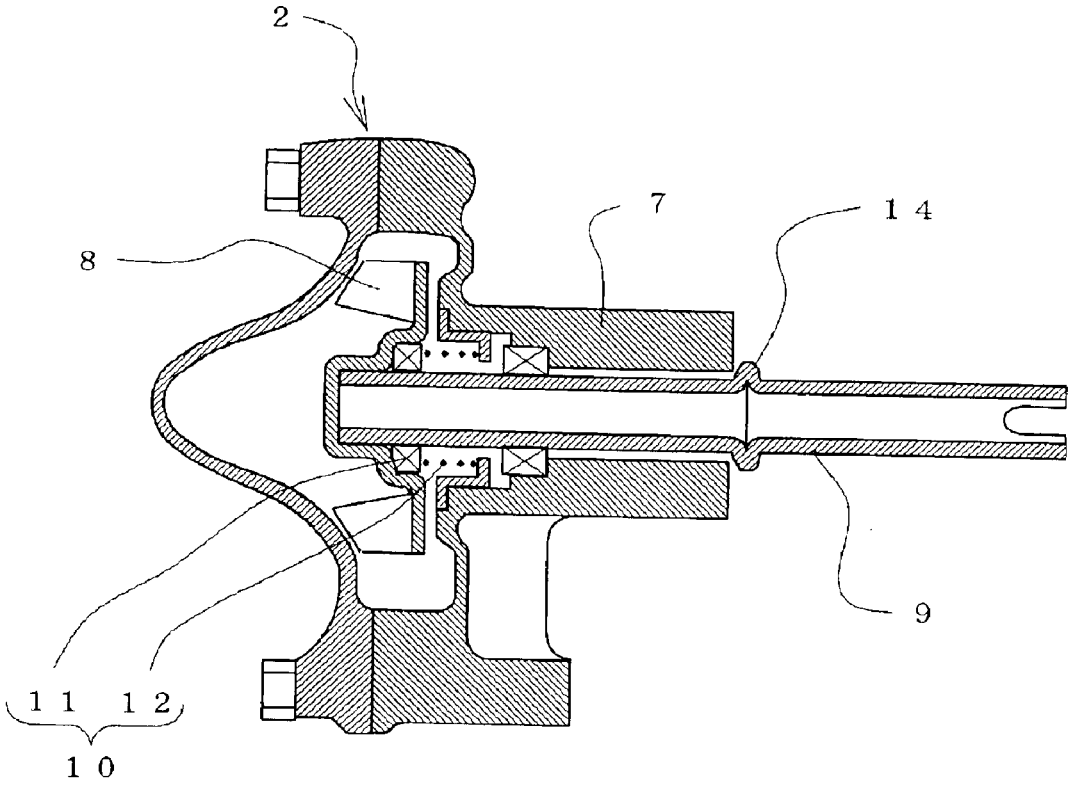
FIG. 7 is a longitudinal sectional view showing another example of the related art.

Further, as shown in FIG. 4, the annular member 31 to contact the engage pin 27 can be formed so that the cross section in the diameter direction is roughly arc-shaped.

With this structure, since the contact between the annular member 31 and the engage pin 27 is almost point-contact, the sliding resistance, namely the rotating resistance of the pump shaft 23, can be reduced. Therefore, smooth rotation of the pump shaft 23 can be ensured.

Furthermore, the flange 31*a* can be formed at the circumference of the annular member 31.

What is claimed is:

1. A water pump comprising:

a pump body;

a pump shaft rotatably supported by said pump body in a piercing arrangement, said pump shaft having a first end to which an impeller is attached, and having a second end opposite said first end;

a mechanical seal elastically arranged via an urging member between said pump body and said first end of said pump shaft; and an engage mechanism between said pump body and said second end of said pump shaft, and arranged to engage said pump shaft to said pump body against an urging force of said urging member, said engage mechanism including:

an annular member rotatably fitted to said pump shaft so as to contact said pump body, said annular member having an annular flange at a circumferential portion thereof; and a cylindrical engage pin piercing said pump shaft in the diameter direction while sandwiching said annular member with said pump body, said engage pin being arranged with respect to said annular member so that said annular flange faces an end face of said engage pin.

2. The water pump of claim 1, wherein said annular member has a roughly circular cross section in the diameter direction.

3. The water pump of claim 2, wherein said impeller is attached integrally to said pump shaft.

4. The water pump of claim 3, wherein said impeller is integrated with said pump shaft by insert molding.

5. The water pump of claim 1, wherein said annular member has a plate-shaped cross section in the diameter direction.

6. The water pump of claim 5, wherein said impeller is attached integrally to said pump shaft.

7. The water pump of claim 6, wherein said impeller is integrated with said pump shaft by insert molding.

8. The water pump of claim 1, wherein said urging member is shaped and arranged so that an expansion-and-contraction stroke of said urging member is at least equal to a height of said annular flange.

9. The water pump of claim 8, wherein said impeller is attached integrally to said pump shaft.

10. The water pump of claim 9, wherein said impeller is integrated with said pump shaft by insert molding.

11. The water pump of claim 1, wherein said impeller is attached integrally to said pump shaft.

12. The water pump of claim 11, wherein said impeller is integrated with said pump shaft by insert molding.

13. The water pump of claim 1, wherein said annular member is bowl-shaped, and has a plate-shaped base portion with said annular flange extending from a circumference of said plate-shaped base portion.

14. The water pump of claim 13, wherein said annular member is rotatably fitted to said pump shaft so that said annular flange extends from said circumference of said plate-shaped base portion in a direction away from said first end of said pump shaft.

* * * * *